US006213852B1

(12) United States Patent
Fujii et al.

(10) Patent No.: US 6,213,852 B1
(45) Date of Patent: Apr. 10, 2001

(54) POLISHING APPARATUS AND METHOD OF MANUFACTURING A SEMICONDUCTOR DEVICE USING THE SAME

(75) Inventors: Kazuyuki Fujii; Takanori Sasaki; Mahito Sawada; Kouichiro Tsutahara, all of Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/350,920

(22) Filed: Jul. 12, 1999

(30) Foreign Application Priority Data

Jan. 27, 1999 (JP) ..... 11-018245

(51) Int. Cl.[7] ..... B24B 29/00; B24B 5/00

(52) U.S. Cl. ..... 451/285; 451/41; 451/287; 451/443; 451/444; 451/446

(58) Field of Search ..... 451/41, 285, 287, 451/443, 444, 446

(56) References Cited

U.S. PATENT DOCUMENTS

| | | | | |
|---|---|---|---|---|
| 3,841,031 | * | 10/1974 | Walsh | 51/283 |
| 4,256,535 | * | 3/1981 | Banks | 156/645 |
| 4,373,991 | * | 2/1983 | Banks | 156/645 |
| 4,800,612 | * | 1/1989 | Valentine | 15/314 |
| 4,910,155 | * | 3/1990 | Cote | 437/8 |
| 5,081,051 | * | 1/1992 | Mattingly | 437/10 |
| 5,158,533 | * | 10/1992 | Strauss | 604/4 |
| 5,216,843 | * | 6/1993 | Breivogel | 51/131 |
| 5,308,438 | * | 5/1994 | Cote | 156/636 |
| 5,486,131 | * | 1/1996 | Cesna | 451/56 |
| 5,502,872 | * | 4/1996 | Chae | 15/320 |
| 5,651,725 | * | 7/1997 | Kikuta | 451/41 |
| 5,866,480 | * | 2/1999 | Murakami | 438/693 |

FOREIGN PATENT DOCUMENTS

| | | | |
|---|---|---|---|
| 57008063 | * | 1/1982 | (JP) . |
| 59031676 | * | 2/1984 | (JP) . |
| 59111673 | * | 6/1984 | (JP) . |
| 05293747 | * | 11/1993 | (JP) . |
| 8-294861 | | 11/1996 | (JP) . |

* cited by examiner

*Primary Examiner*—Stephen F. Gerrity
*Assistant Examiner*—Paul Kim
(74) *Attorney, Agent, or Firm*—McDermott, Will & Emery

(57) ABSTRACT

A method of manufacturing a semiconductor device using a polishing apparatus is provided. A top ring holding a wafer is arranged on a pad. A polishing chemical liquid supply line for supplying a polishing chemical liquid is arranged above the pad in a direction ahead of rotation with respect to the top ring. Around the center of rotation of the pad, a partition plate having a columnar side surface is arranged. Above the pad on a side which goes away from the top ring when the pad is rotated, a polishing chemical liquid draining mechanism is arranged extending continuously from the partition plate to the outer periphery of the pad. Accordingly, a polishing apparatus is obtained by which the amount of polishing of the surface to be polished of the semiconductor substrate is stabilized and generation of microscratches on the surface to be polished can be suppressed.

7 Claims, 12 Drawing Sheets

POLISHING APPARATUS AND METHOD OF MANUFACTURING A SEMICONDUCTOR DEVICE USING THE SAME

BACKGROUND OF THE INVENTION

1. Field of the Invention

The present invention relates to a polishing apparatus and to a method of manufacturing a semiconductor device using the polishing apparatus. More specifically, the present invention relates to a polishing apparatus ensuring stable polishing characteristic, and suppressing generation of micro scratches in a step of polishing during manufacturing of a semiconductor device, as well as to a method of manufacturing a semiconductor device using the polishing apparatus.

2. Description of the Background Art

As one of the measures to meet higher degree of integration and miniaturization of semiconductor devices, a method of planarizing a surface of a semiconductor substrate by Chemical Mechanical Polishing (hereinafter referred to as "CMP method") in the manufacturing process has been known. A polishing apparatus described in Japanese Patent Laying-Open No. 8-294861 as an example of a polishing apparatus for the conventional CMP method will be described in the following.

Referring to FIGS. 21 and 22, on a rotary disk 113 rotating in a horizontal plane, a polishing cloth 115 for polishing a surface to be polished is adhered. Above rotary disk 113, a wafer holding base 114 is arranged for holding a wafer 116 such that the surface to be polished of a semiconductor substrate is opposed to the surface of polishing cloth 115. The center of rotation of wafer holding base 114 is arranged offset by a prescribed offset distance E from the center D of rotation of. rotary disk 113.

Above rotary disk 113, a polishing liquid supply tube 117 for supplying polishing liquid to polishing surface 115*a* of polishing cloth 115, and a dressing liquid supply tube 120 for supplying dressing liquid to polishing surface 115*a* are provided. Further, above rotary disk 113, a liquid draining mechanism 123 for draining waste polishing liquid and dressing liquid after polishing from polishing surface 115*a* is provided.

The diameter of wafer holding base 114 is shorter than the radius of rotary disk 113, and wafer holding base 114 and rotary disk 113 rotate in the directions represented by arrows A and B, respectively. In FIG. 22, a two-dotted circle F represents a track drawn near the center of rotation of polishing cloth 115 by an outer periphery of wafer 116 held by wafer holding base 114.

Main portions of the conventional polishing apparatus are structured as described above.

The operation of the polishing apparatus will be described in the following. To polishing surface 115*a* adhered on rotary disk 113 rotating at a constant rate, a polishing liquid containing fine alumina particles is supplied from polishing liquid supply tube 117. At the same time, dressing liquid is supplied to polishing surface 115*a* from dressing liquid supply tube 120. Wafer holding base 114 is moved downward while wafer holding base 114 on which a wafer 116 is fixed is rotated at a constant rate. A surface 116*a* to be polished of wafer 116 is pressed onto polishing surface 115*a* so that the surface 116*a* is polished. After polishing process, the waste polishing liquid and dressing liquid are recovered by liquid draining mechanism 123. In this manner, wafer 116 is polished.

The polishing process by the above described polishing apparatus, however, has the following problems. Referring to FIG. 23, part of the polishing liquid supplied from polishing liquid supply tube 117 may undesirably flow directly to a region of polishing surface 115*a* which goes away from wafer holding base 114 because of the disk 113 rotation, or to a region of polishing surface 115*a* which goes away from dressing liquid supply tube 120 because of disk 113 rotation, as represented by solid arrows. Further, part of the dressing liquid supplied from dressing liquid supply tube 120 may possibly flow directly to a region of polishing surface 115*a* which goes away from liquid draining mechanism 123 because of disk 113 rotation, or to a region of polishing surface 115*a* which goes away from polishing liquid supply tube 117 by disk 113 rotation, as represented by dotted arrows.

Further, it is possible that the waste polishing liquid after polishing directly flows to a region of polishing surface 115a which goes away from liquid draining mechanism 123 by disk 113 rotation. Accordingly, it is possible that the supplied polishing liquid and dressing liquid are mixed with each other, or polishing liquid and waste polishing liquid are mixed with each other, resulting in variation of polishing amount of the surface to be polished of the wafer, as well as in generation of micro scratches of the surface to be polished of the wafer caused by chippings.

SUMMARY OF THE INVENTION

The present invention was made in view of the above described problems, and its object is to provide a polishing apparatus ensuring stable polishing characteristic and suppressing generation of micro scratches on a surface to be polished of a semiconductor substrate, as well as to provide a method of manufacturing a semiconductor device using the polishing apparatus.

The polishing apparatus in accordance with one aspect of the present invention includes a polishing surface portion, a polishing unit, a chemical liquid supply unit and a waste liquid draining unit. The polishing surface rotates about a center of rotation, and polishes a surface to be polished, or an object surface. The polishing unit is arranged on and opposing to the polishing surface, and performs a series of polishing and washing operations. The polishing unit refers to a unit holding the surface to be polished, or a unit for cleaning the polishing surface. The chemical liquid supply unit is arranged on the polishing surface on a side which comes closer to the polishing unit when the polishing surface the polishing surface portion is rotated, and supplies chemical liquid for polishing to the polishing surface. The waste liquid draining unit is arranged on the polishing surface on a side which goes away from the polishing unit when the polishing surface portion is rotated, and removes the waste liquid on the polishing surface. Around the center of rotation of polishing surface, a partition unit is formed together with the waste liquid draining unit, for preventing flow of the chemical liquid and the waste liquid to a region of the polishing surface which goes away from the waste liquid draining unit when the polishing surface portion is rotated, through the region near the center of rotation. The waste liquid draining unit is arranged continuous from the partition unit to the outer periphery of the polishing surface.

Because of this structure, especially by the partition unit and the waste liquid draining unit arranged continuously from the partition unit to the outer periphery of the polishing surface, the chemical liquid and waste liquid after polishing are surely removed from the polishing surface, without any possibility of flowing to the region of the polishing surface which goes away from the waste liquid draining unit when the polishing surface portion is rotated to be mixed with the chemical liquid to be used for polishing. As a result, it is ensured that the surface to be polished is polished by the chemical liquid which is free of any waste liquid containing chippings, whereby the amount of polishing on the surface is made stable, and further, generation of micro scratches or the like on the surface to be polished caused by chippings can be suppressed. Further, as the chemical liquid and waste liquid after polishing are surely removed from the polishing surface, it is possible to continuously perform polishing operations using different types of chemicals by one same polishing surface, without the necessity of exchanging the polishing surface for the different types of chemicals, so that throughput of the polishing apparatus is improved.

Preferably, the chemical liquid supplying unit has a foam body extending continuously from the partition unit to the outer periphery of the polishing surface for uniformly supplying chemical liquid to the polishing surface.

Here, the chemical liquid is supplied uniformly on the polishing surface, so that the surface to be polished is polished uniformly. As a result, variation in the amount of polishing the object surface is suppressed.

Preferably, the waste liquid draining unit includes an evacuating unit for sucking waste liquid, and a liquid removing unit for removing the liquid in the waste liquid, provided in a preceding stage of the evacuating unit.

Here, when the waste liquid is sucked by the evacuating unit, the liquid or moisture of the waste liquid is removed by the liquid removing unit, and therefore draining can be continued with the evacuating capability of the evacuating unit not degraded. As a result, the waste liquid can surely be drained from the polishing surface.

Preferably, the waste liquid draining unit includes a filter unit for removing solids contained in the waste liquid, provided in a preceding stage of the liquid removing unit.

Here, solids such as chippings contained in the waste liquid are prevented from reaching the evacuating unit to cause malfunction. As a result, removal of waste liquid is further ensured.

Preferably, the polishing unit includes a substrate holding unit holding a semiconductor substrate and arranging a surface to be polished of the semiconductor substrate opposed to the polishing surface, and a polishing surface cleaning unit for cleaning the polishing surface. The chemical liquid supplying unit includes a polishing chemical liquid supplying unit for supplying a polishing chemical liquid to the polishing surface, and a cleaning liquid supplying unit for supplying cleaning liquid to the polishing surface. The waste liquid draining unit includes a polishing waste liquid draining unit for draining polishing waste liquid on the polishing surface, and a cleaning waste liquid draining unit for draining cleaning waste liquid on the polishing surface. These units are arranged on the polishing surface in the following order along the direction of rotation: polishing chemical liquid supplying unit, substrate holding unit, polishing waste liquid draining unit, cleaning liquid supplying unit, polishing surface cleaning unit and cleaning waste liquid draining unit. The partition unit and the polishing waste liquid draining unit prevent the polishing chemical liquid and polishing waste liquid from flowing to the region of the polishing surface which goes away from the polishing waste liquid draining unit when the polishing surface portion is rotated, and the partition unit and the cleaning waste liquid draining unit prevent the cleaning liquid and the cleaning waste liquid from flowing to the region of the polishing surface which goes away from the cleaning waste liquid draining unit when the polishing surface portion is rotated. In this case, the polishing waste liquid and the polishing chemical liquid after polishing are surely removed from the polishing surface, not mixed with the cleaning liquid for cleaning the polishing surface, and in addition, the cleaning waste liquid and the cleaning liquid after cleaning the polishing surface are surely removed from the polishing surface, not mixed with the polishing chemical liquid to be used for polishing. As a result, the object surface to be polished of the semiconductor substrate is always polished by the polishing chemical liquid not mixed with any waste liquid and the polishing surface of a constant cleanliness, so that the variation in the amount of polishing of the object surface is further stabilized, and generation of micro scratches on the object surface can effectively be suppressed.

According to another aspect, the present invention provides a method of manufacturing a semiconductor device using a polishing apparatus including a rotating polishing surface to which a semiconductor substrate is opposed, for polishing an object surface of the semiconductor substrate, wherein the polishing surface has a polishing region on which a series of polishing operations from supply of a polishing chemical liquid to the polishing surface for polishing the semiconductor substrate until draining of polishing waste liquid after polishing is performed, and a cleaning region on which a series of cleaning operations from supply of a cleaning liquid for cleaning the polishing surface to cleaning of the polishing surface until draining of the cleaning waste liquid after cleaning are performed. The manufacturing method includes the following steps. An anti-polishing film preventing polishing is formed on a main surface of the semiconductor substrate. An insulating film is formed on the anti-polishing film. The semiconductor substrate is placed opposed to the polishing surface, and the insulating film is polished ensuring a certain thickness on the antipolishing film, while preventing flow of first polishing chemical liquid as a polishing chemical liquid and polishing waste liquid to a region of the polishing surface which goes away from the polishing region when the polishing surface portion is rotated (first polishing step). The polishing surface is cleaned while preventing the cleaning liquid and the cleaning waste liquid from flowing to the region of the polishing surface which goes away from the cleaning region when the polishing surface portion is rotated (cleaning step). Thereafter, the insulating film is further polished while preventing a second polishing chemical liquid of a different type from the first polishing chemical liquid and the polishing waste liquid from flowing to the region of the polishing surface which goes away from the polishing region when the polishing surface portion is rotated.

According to the manufacturing method, the first or second polishing chemical liquid and the polishing waste liquid in the first and second polishing steps is prevented from flowing again to the polishing region to be mixed with the polishing chemical liquid to be used for operation or flowing to the cleaning region to be mixed with the cleaning liquid, but is surely drained from the polishing surface. As a result, the surface to be polished of the semiconductor substrate is always polished by the polishing surface having a prescribed cleanliness and a polishing chemical liquid not mixed with any polishing waste liquid or cleaning waste liquid containing chippings or the like, so that the amount of polishing of the object surface is stabilized, and in addition, generation of micro scratches on the object surface by the chippings or the like can be suppressed.

Further, the polishing chemical liquid, the polishing waste liquid, the cleaning liquid and the cleaning waste liquid are surely drained from the polishing surface, not mixed with the polishing chemical liquid and the cleaning liquid newly supplied to the polishing surface. Therefore, when polishing chemical liquids of different types are to be used, it is possible to perform the first polishing step and the second polishing step continuously, using one same polishing surface, without the necessity of exchanging the polishing surface. This improves throughput of the polishing apparatus.

Preferably, in the first polishing step, polishing selectivity or selective ratio between the insulating film and the anti-polishing film with the first polishing chemical liquid is relatively low, and in the second polishing step, the polishing selectivity between the insulating film and the anti-polishing film with the second polishing chemical liquid is relatively high.

Accordingly, in the first polishing step, the insulating film is polished uniformly from the surface entirely over the semiconductor substrate, and in the second polishing step, the insulating film left on the anti-polishing film is surely polished.

In the polishing steps, preferably, a silicon nitride film may be used as the anti-polishing film, a silicon oxide film may be used as the insulating film, silica slurry ($SiO_2$ base) may be used as the first chemical liquid, and ceria slurry ($CeO_2$ base) may be used as the second chemical liquid.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
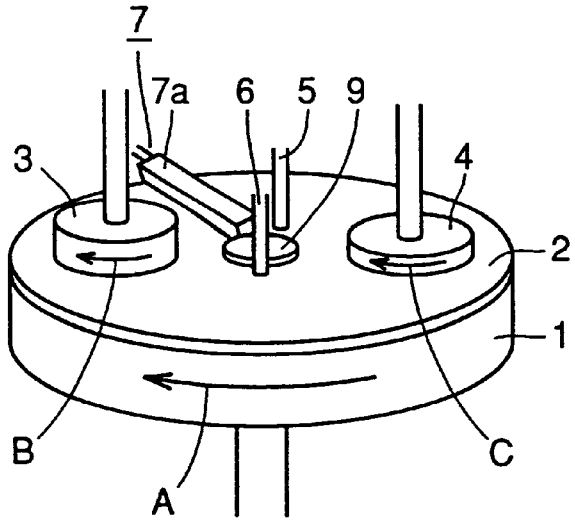
FIG. 1 is a perspective view of the polishing apparatus in accordance with a first embodiment of the present invention.
Figure 2:
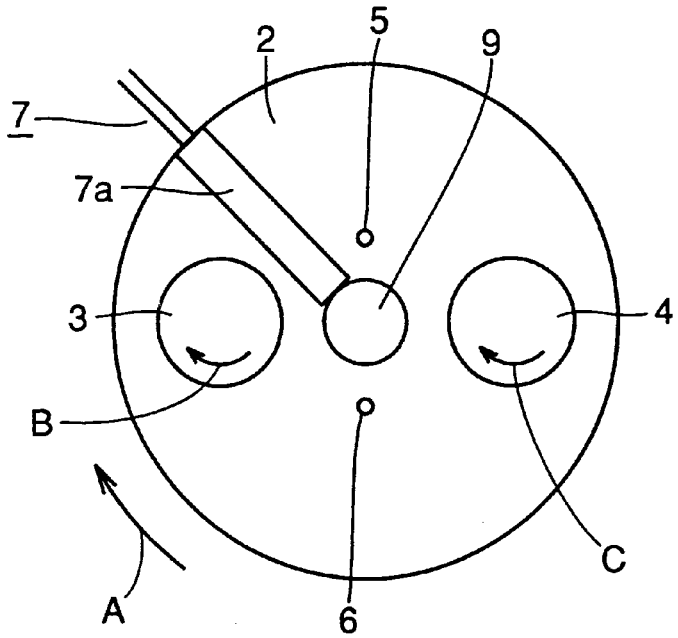
FIG. 2 is a top view of the polishing apparatus of the first embodiment.

A polishing apparatus in accordance with the first embodiment of the present invention will be described with reference to the figures. Referring to FIGS. 1 and 2, a pad 2 is attached on a surface of a platen 1 rotating about a rotary axis. A top ring 3 is arranged opposed to the surface of pad 2. Platen 1 and top ring 3 rotate in the directions represented by arrows A and B, respectively. As will be described later, top ring 3 holds a wafer such that a surface to be polished of the wafer opposes to the surface of pad 2. Above that region of pad 2 which comes closer to top ring 3 when pad 2 rotates, a polishing chemical liquid supply line 6 for supplying polishing chemical liquid to pad 2 is arranged.

Around the center of rotation of pad 2, there is provided a polishing chemical liquid draining mechanism 7, which will be described later, and a partition plate 9 preventing polishing waste liquid or the like after polishing from flowing through a region near the center of rotation to that region of pad 2 which goes away from the polishing chemical liquid draining mechanism 7 when the pad 2 is rotated. As illustrated in FIGS. 1 and 2, the partition plate 9 is disk-shaped, and centrally positioned to cover the center of rotation of the pad 2. In addition, the outer periphery of the disk-shaped partition plate 9 continuously surrounds the center of rotation of the pad 2. Above that region of pad 2 which goes away from top ring 3 when pad 2 is rotated, the polishing chemical liquid draining mechanism 7 for draining the polishing waste liquid on pad 2 is arranged. The polishing chemical liquid drain mechanism 7 is arranged continues from partition plate 9 to the outer periphery of pad 2.

On pad 2, there is provided a dresser 4 for cleaning pad 2. Dresser 4 rotates in a direction represented by an arrow C, for example. On that region of pad 2 which comes closer to dresser 4 when pad 2 rotates, there is a dressing chemical liquid supply line 5 for supplying a dressing chemical liquid to pad 2.

Figure 3:
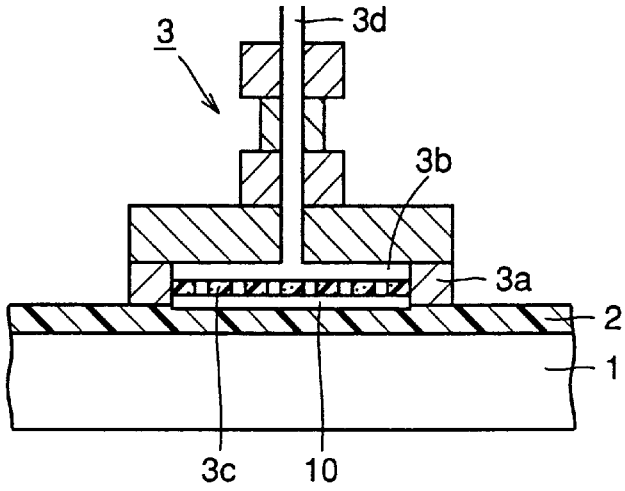
FIG. 3 is a cross sectional view of a top ring of the polishing apparatus in accordance with the first embodiment.

Details of the structures of respective portions will be described in the following. Referring to FIG. 3, top ring 3 holds a wafer 10 such that the surface to be polished opposes to pad 2. Top ring 3 has a retainer ring 3*a* and a resilient film 3*c*, among others, to provide a pressure chamber 3*b*. Wafer 10 is arranged on a porous resilient film 3*c* with its surface to be polished being opposed to pad 2, and held by evacuation of pressure chamber 3*b* through a duct 3*d*.

Figure 4:
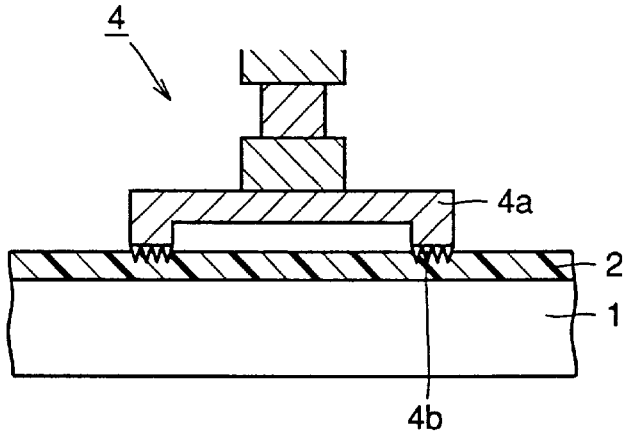
FIG. 4 is a cross sectional view of a dresser of the polishing apparatus in accordance with the first embodiment.
Figure 5:
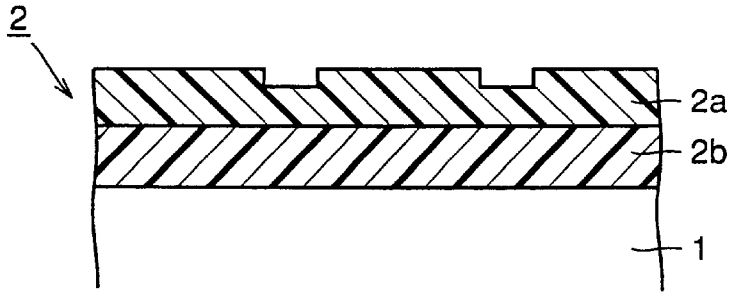
FIG. 5 is a partial cross section of a pad portion of the polishing apparatus in accordance with the first embodiment.

Referring to FIG. 4, dresser 4 has a diamond wheel 4*a* with a surface 4*b* having diamond powders electro-deposited thereon. Referring to FIG. 5, pad 2 consists of a continues urethane foam 2*b* formed on platen 1, and a independent hard polyurethane 2*a* with trenches formed thereon.

Figure 6:
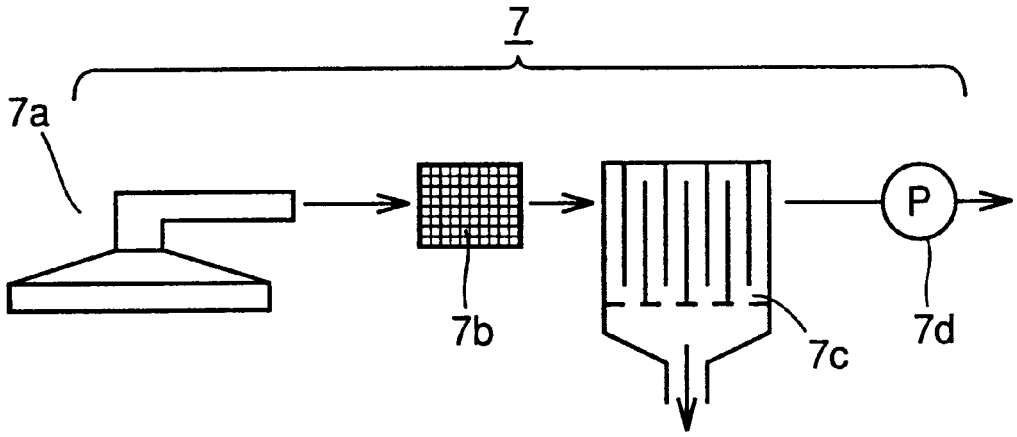
FIG. 6 is an illustration of a polishing chemical liquid removing mechanism of the polishing apparatus in accordance with the first embodiment.

Further, referring to FIG. 6, polishing chemical liquid draining mechanism 7 includes a draining body 7*a*, a filter 7*b*, a water track 7*c* and a vacuum pump 7*d*. The foregoing is the basic structure of the polishing apparatus.

The operation of the polishing apparatus will be described in the following. Referring to FIGS. 1 and 2, platen 1 and top ring 3 holding the wafer thereon rotate in the directions of arrows A and B, respectively. The polishing chemical liquid is supplied from polishing chemical liquid supply line 6 to pad 2. The surface to be polished of the rotating wafer is pressed against the rotating pad 2, whereby the object surface is polished. The polishing waste liquid and polishing chemical liquid are drained after H polishing by polishing chemical liquid draining mechanism 7 from pad 2.

To pad 2, dressing chemical liquid such as pure water is supplied from dressing chemical liquid supply line 5. The surface of pad 2 is cleaned as the diamond deposited surface 4*b* of rotating dresser 4 is pressed against pad 2. In this manner, a series of operations for polishing the surface of the wafer is performed.

In the polishing apparatus described above, partition plate 9 and polishing chemical liquid draining mechanism 7 arranged continuous from the partition plate 9 to the outer periphery of pad 2 are provided. Accordingly, the polishing chemical liquid supplied to pad 2 and the polishing waste liquid after polishing do not flow through a region near the center of rotation of pad 2 to that region of pad 2 which goes away from the polishing chemical liquid draining mechanism 7 when pad 2 rotates, and therefore they are not mixed with the polishing chemical liquid to be used for polishing, but surely removed from pad 2.

As a result, the surface of the wafer is always polished by the polishing chemical liquid not mixed with the waste polishing liquid containing chippings or the like, whereby the amount of polishing on the object surface is stabilized, and generation of micro scratches on the object surface caused by chippings can be suppressed.

Further, in the polishing apparatus described above, the polishing chemical liquid draining mechanism 7 especially has filter 7*b* and water track 7*c*, and therefore chippings and moisture can be removed. As a result, the suction capability and life of vacuum pump 7*d* are not degraded.

Figure 7:
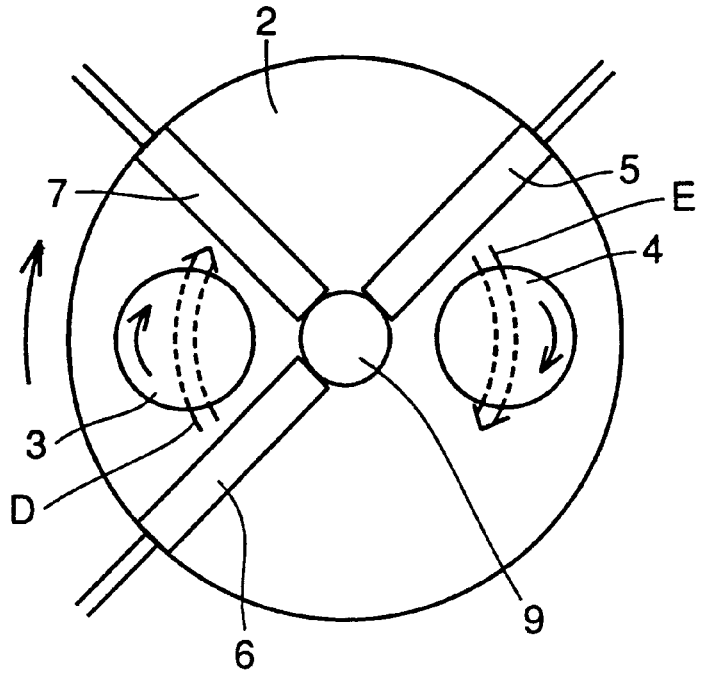
FIG. 7 is a top view representing a modification of the polishing apparatus in accordance with the first embodiment.
Figure 8:
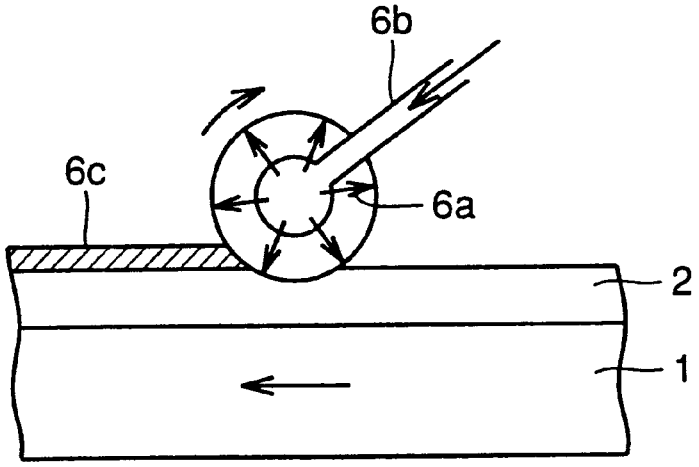
FIG. 8 is a partial cross section of the polishing apparatus shown in FIG. 7.

In the polishing apparatus in accordance with the present embodiment, a polishing chemical liquid supply line 6 having a foam body 6*a* extending from partition plate 9 to the outer periphery of pad 2 continuously may be applied, as shown in FIGS. 7 and 8. Here, the polishing chemical liquid is supplied uniformly onto pad 2 from polishing chemical liquid duct 6*b* through the foam body 6*a*, and a polishing chemical liquid coating 6*c* is formed on pad 2 to the direction of the arrow D.

As a result, the surface to be polished of the wafer is polished more uniformly, and variation in amount of polishing over the wafer is suppressed. Further, the amount of chemical liquid used can be reduced than when the polishing chemical liquid is dropped, and therefore the effect of draining is also improved, as the amount of waste liquid after polishing decreases.

When a similar structure as polishing chemical liquid supply line 6 is adapted for the dressing chemical liquid supply line 5, a dressing chemical liquid coating is formed on pad 2 in the direction of the arrow E, and hence the effect of cleaning pad 2 is improved.

Second Embodiment

Figure 9:
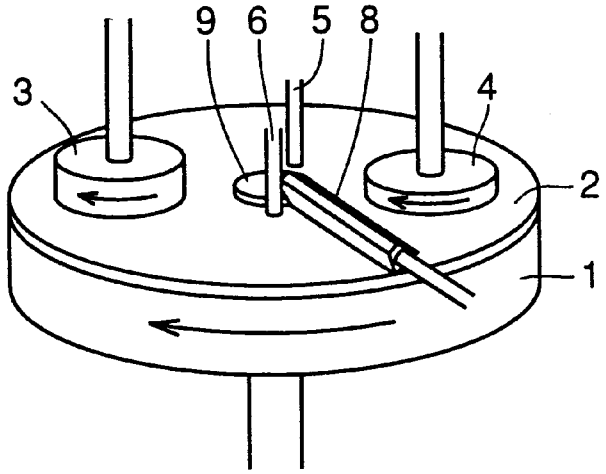
FIG. 9 is a perspective view of the polishing apparatus in accordance with a second embodiment of the present invention.
Figure 10:
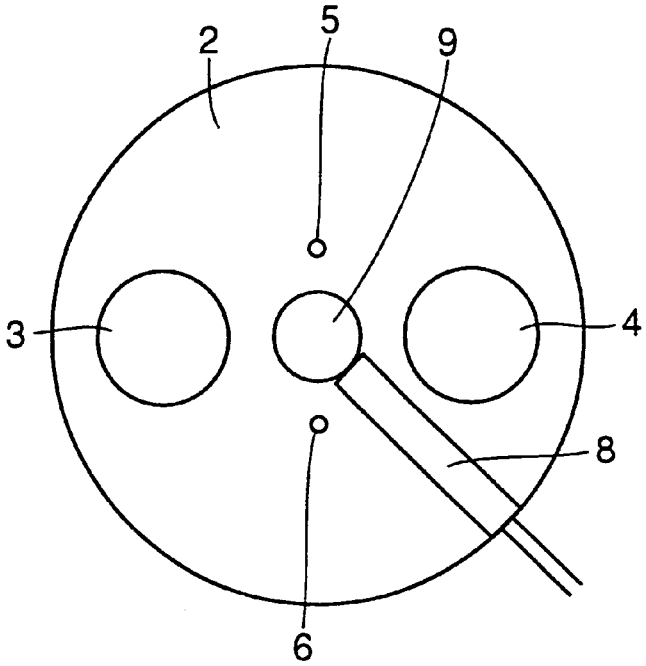
FIG. 10 is a top view of the polishing apparatus in accordance with the second embodiment.
Figure 11:
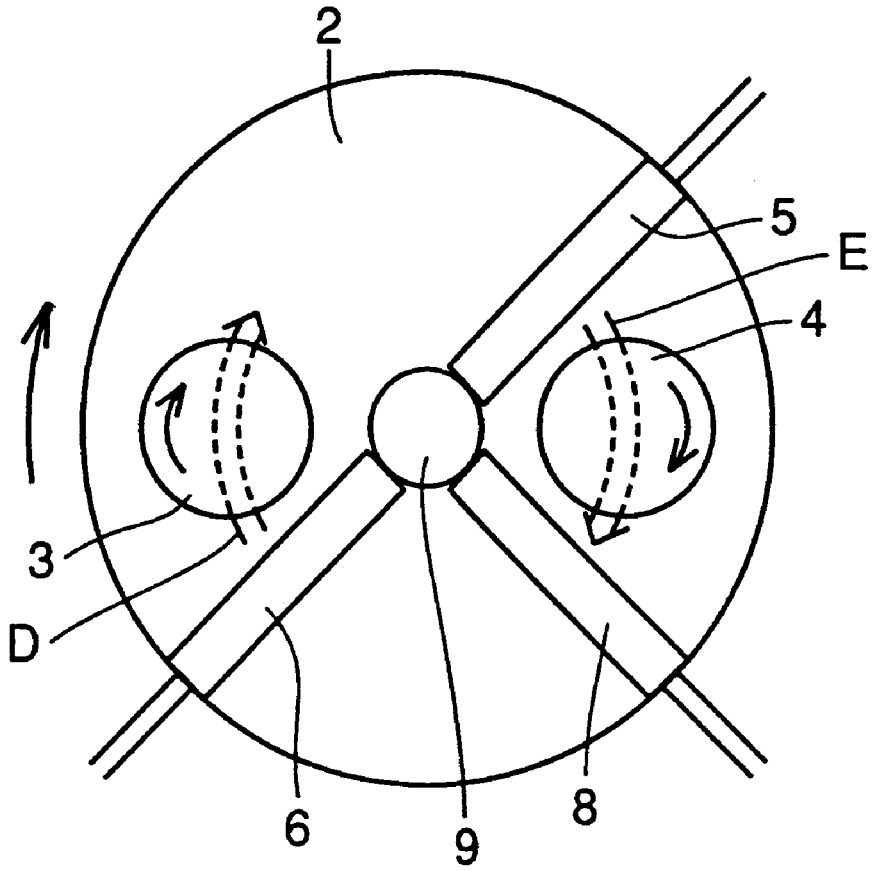
FIG. 11 is a top view representing a modification of the polishing apparatus in accordance with the second embodiment.

The polishing apparatus in accordance with the second embodiment of the present invention will be described with reference to the figures. Referring to FIGS. 9 and 10, the polishing apparatus in accordance with the present embodiment has, among others, a dressing chemical liquid draining mechanism for draining dressing waste liquid after cleaning the pad 2. Dressing chemical liquid draining mechanism 8 also serves to drain the polishing waste liquid after polishing. Except this point, the polishing apparatus has the same structure as that of the first embodiment described with reference to FIGS. 1 and 2, and therefore corresponding portions are denoted by the same reference characters and description thereof is not repeated.

In the polishing apparatus described above, dressing chemical liquid draining mechanism 8 which also serves to drain the polishing waste liquid after polishing is arranged continuously from the partition plate 9 to the outer periphery of pad 2. Therefore, the polishing waste liquid after polishing and dressing waste liquid after cleaning of the pad are prevented from flowing through the region near the center of rotation of pad 2 to that region of pad 2 which goes away from the dressing chemical liquid draining mechanism 8 when pad 2 rotates to be mixed with the polishing chemical liquid to be used for polishing, but are surely removed from pad 2.

As a result, the surface to be polished of the wafer is always polished by the polishing chemical liquid not mixed with any dressing waste liquid containing dirt or the like nor with the polishing waste liquid containing chippings, so that the amount of polishing of the object wafer surface is stabilized, and generation of micro scratches on the surface to be polished can be suppressed.

In the polishing apparatus in accordance with the present embodiment, a line formed continuously from partition plate 9 to the outer periphery of pad 2 may be used as the polishing chemical liquid supply line 6 and dressing chemical liquid supply line 5. In this case also, as described in a modification of the first embodiment, a polishing chemical liquid coating 6*c* is formed in the direction of the arrow D on pad 2, so that the surface of the wafer is polished uniformly, and variation in the amount of polishing over the wafer surface is suppressed. Further, a dressing chemical liquid coating is formed in the direction of the arrow E on pad 2, and the effect of cleaning pad 2 is improved.

Third Embodiment

Figure 12:
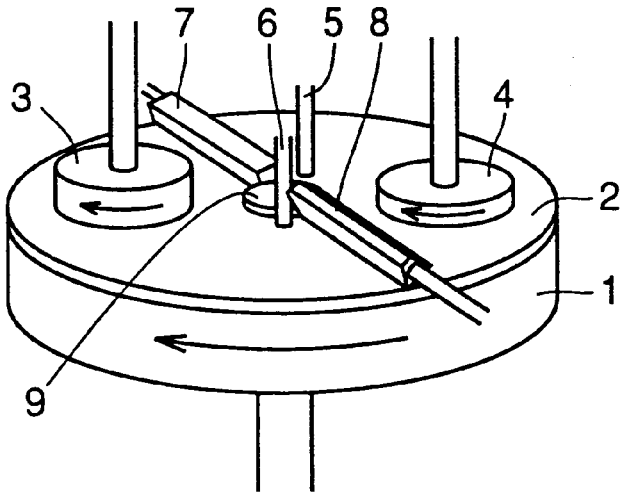
FIG. 12 is a perspective view of the polishing apparatus in accordance with a third embodiment of the present invention.
Figure 13:
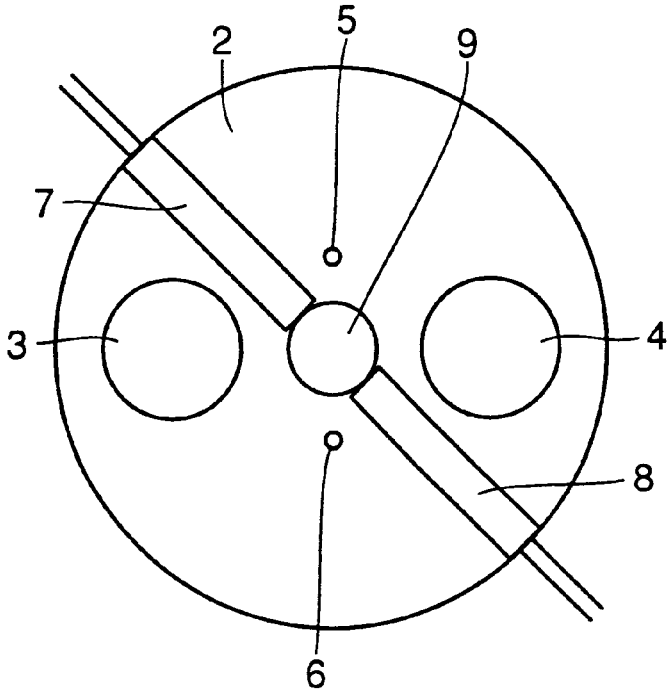
FIG. 13 is a top view of the polishing apparatus in accordance with the third embodiment.

A polishing apparatus in accordance with a third embodiment of the present invention will be described in the following. Referring to FIGS. 12 and 13, the polishing apparatus in accordance with the present embodiment has such a structure that is a combination of the polishing apparatuses in accordance with the first and second embodiments. More specifically, the polishing apparatus includes a polishing chemical liquid draining mechanism 7 and a dressing chemical liquid draining mechanism 8 formed continuously from partition plate 9 to the outer periphery of pad 2, respectively.

Accordingly, on pad 2, polishing chemical liquid supply line 6, top ring 3, polishing chemical liquid draining mechanism 7, dressing chemical liquid supply line 5, dresser 4 and dressing chemical liquid draining mechanism 8 are arranged in this order along the direction of rotation, on pad 2. Other portions are the same as those of the polishing apparatus described with respect to the first and second embodiments. Therefore, corresponding portions are denoted by the same reference characters and description thereof is not repeated.

In the polishing apparatus described above, the polishing waste liquid after polishing and dressing waste liquid after cleaning of the pad are not mixed with the polishing chemical liquid used for polishing but surely removed from pad 2, by means of partition plate 9, polishing chemical liquid draining mechanism 7 and dressing chemical liquid draining mechanism 8.

As a result, the surface to be polished is always polished by the polishing chemical liquid not mixed with the polishing waste liquid or dressing waste liquid containing chippings or dirt, so that the amount of polishing of the surface is stabilized, and generation of micro scratches on the surface caused by chippings or the like can further be suppressed. In addition, pad 2 comes to have longer life.

Further, by the partition plate 9, polishing chemical liquid draining mechanism 7 and dressing chemical liquid draining mechanism 8, the polishing waste liquid after polishing and dressing waste liquid after the cleaning of the pad are surely removed from pad 2, not mixed with the dressing chemical liquid to be used for cleaning of the pad. As a result, pad 2 is always cleaned by the dressing chemical liquid not mixed with any polishing waste liquid or dressing waste liquid containing chippings or dirt removed by cleaning, and hence the effect of cleaning pad 2 can further be improved.

Figure 14:
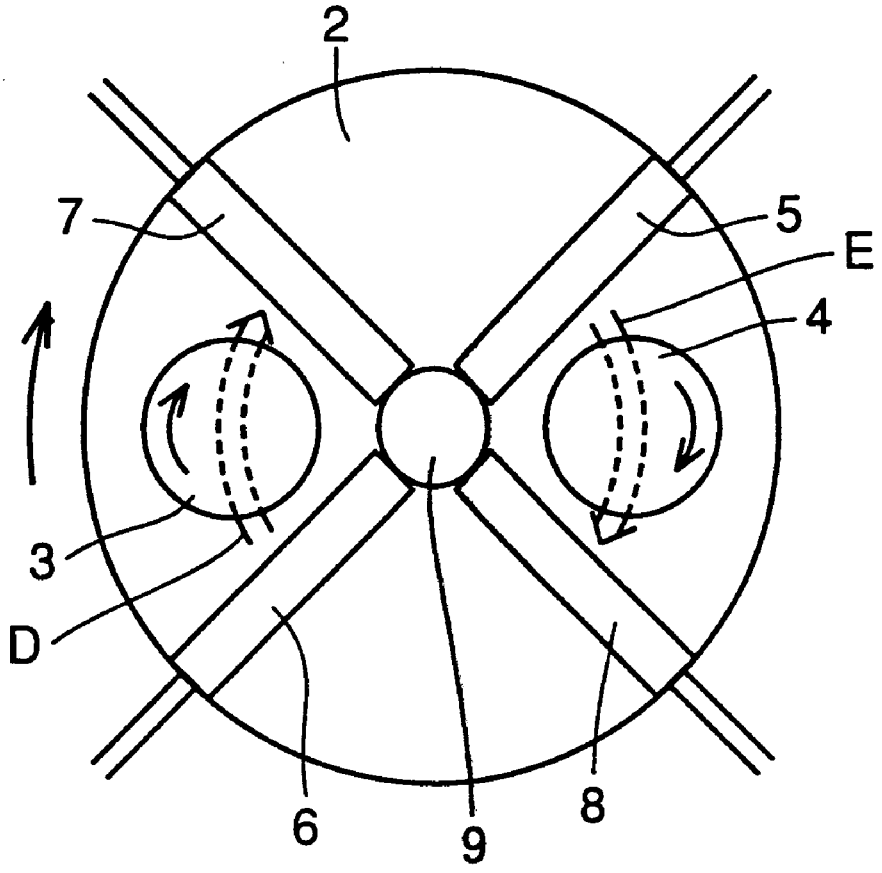
FIG. 14 is a top view representing a modification of the polishing apparatus in accordance with the third embodiment.

In the polishing apparatus of the present embodiment, when polishing chemical liquid supply line 6 and dressing chemical liquid supply line 5 are provided as ones formed continuous from the partition plate 9 to the outer periphery of pad 2, as represented in FIG. 14, similar effects as described in the modifications of the first and second embodiments can be attained.

Fourth Embodiment

In the following, a method of manufacturing a semiconductor device using polishing apparatus in accordance with the third embodiment, applied to the process step of STI (Shallow Trench Isolation) will be described with reference to the figures, as a fourth embodiment of the present invention.

Figure 15:
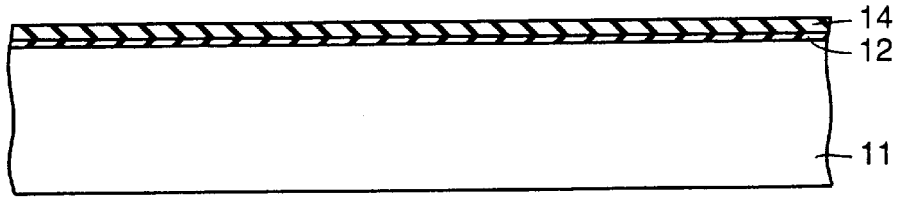
FIG. 15 is a cross sectional view representing a step of a method of manufacturing a semiconductor device in accordance with a fourth embodiment of the present invention.
Figure 16:
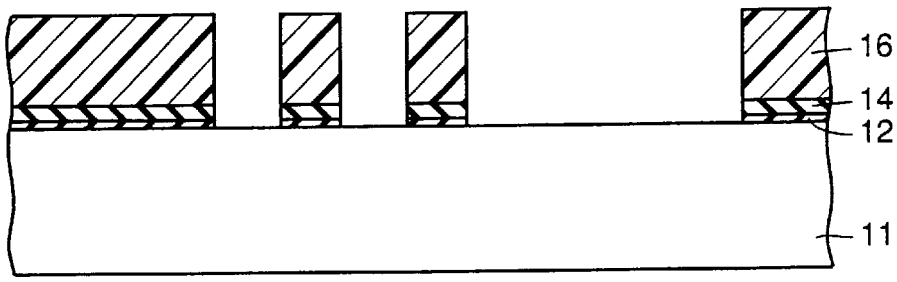
FIG. 16 is a cross sectional view showing a step following the step of FIG. 15 in the fourth embodiment.
Figure 17:
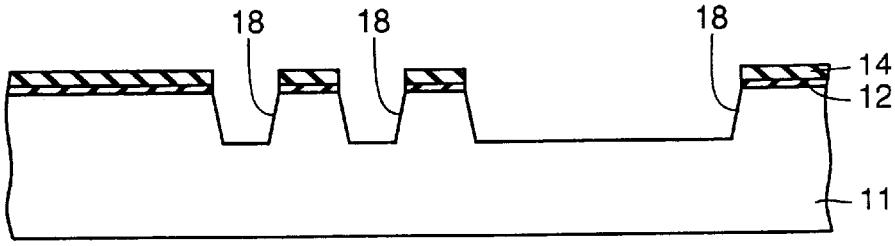
FIG. 17 is a cross sectional view representing a step following the step of FIG. 16 in accordance with the fourth embodiment.

First, referring to FIG. 15, a silicon oxide film 12 is formed on silicon substrate 11 by the CVD method. Thereafter, a silicon nitride film 14 is formed by the CVD method on silicon oxide film 12. Thereafter, referring to FIG. 16, a prescribed photo resist pattern 16 is formed on silicon nitride film 14. Using photo resist pattern 16 as a mask, silicon nitride film 14 and silicon oxide film 12 are subjected to anisotropic etching, so that the surface of semiconductor substrate 11 is exposed. Thereafter, photo resist pattern 16 is removed.

Thereafter, using silicon nitride film 14 and silicon oxide film 12 as a mask, semiconductor substrate 11 is subjected to anisotropic etching, whereby a trench 18 is formed. Thereafter, referring to FIG. 18, a silicon oxide film 20 is formed by the CVD method or the like on semiconductor substrate 11 to fill trench 18.

Thereafter, using the polishing apparatus in accordance with the third embodiment, silicon oxide film 20 is polished. In this step of polishing, particularly, polishing is performed in two stages, in which different types of polishing chemical liquids are used respectively. More specifically, silica slurry ($SiO_2$ base) and ceria slurry ($CeO_2$ base) are used.

The polishing selectivity (selection ratio) between silicon oxide film and silicon nitride film with respect to silica slurry is relatively small (up to 3), and therefore even the silicon nitride film, which serves as a stopper, is polished. Therefore, it is difficult to control the amount of polishing silicon oxide film 20.

By contrast, polishing selectivity between silicon oxide film and silicon nitride film with respect to ceria slurry is relatively large (50 to 150), and therefore polishing of silicon nitride film as a stopper is suppressed. It is difficult, however, to polish a silicon oxide film having a prescribed level difference L2 or larger (≧~3000 Å) formed at a relatively narrow region such as shown in FIG. 18.

As described above, silica slurry ($SiO_2$ base) and ceria slurry ($CeO_2$ base) have much different polishing characteristics. Therefore, in order that these two slurries exhibit their characteristics fully, silica slurry ($SiO_2$ base) is used first, and thereafter ceria slurry ($CeO_2$ base) is used, for respective polishing operations.

Figure 18:
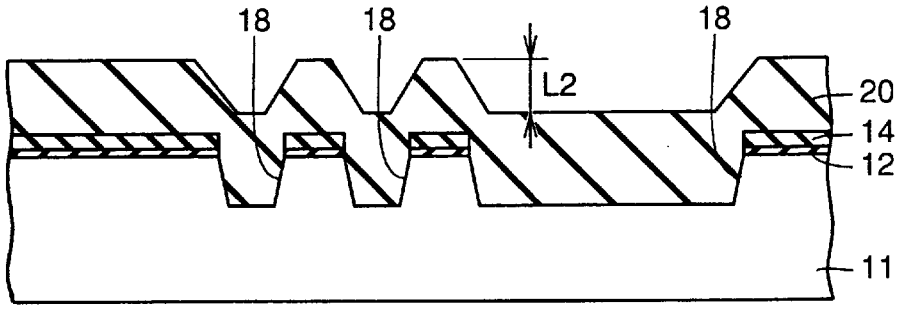
FIG. 18 is a cross sectional view representing a step following the step of FIG. 17 in accordance with the fourth embodiment.
Figure 19:
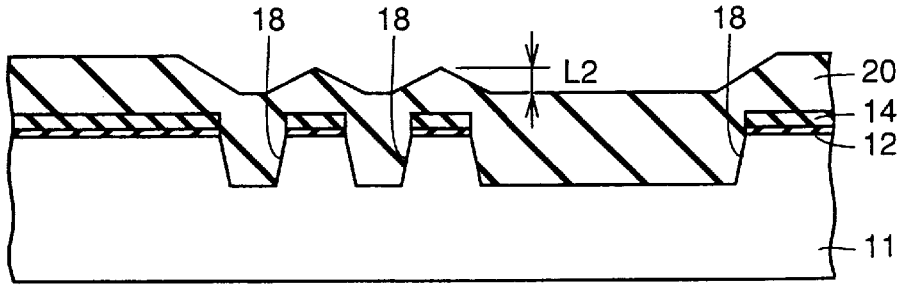
FIG. 19 is a cross sectional view representing a step following the step of FIG. 18 in accordance with the fourth embodiment.
Figure 20:
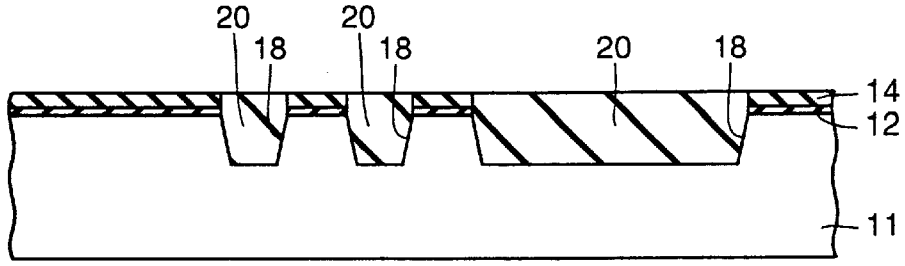
FIG. 20 is a cross sectional view representing a step following the step of FIG. 19 in accordance with the fourth embodiment.
Figure 21:
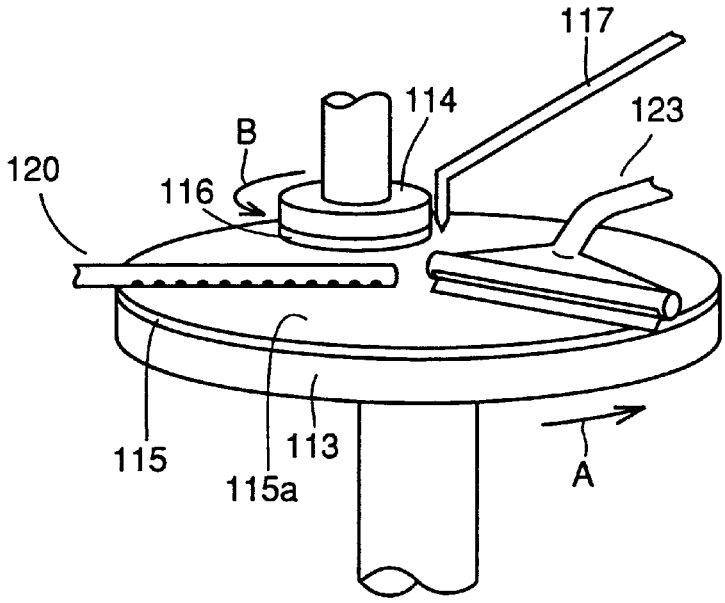
FIG. 21 PRIOR ART
FIG. 21 is a perspective view of a conventional polishing apparatus.
Figure 22:
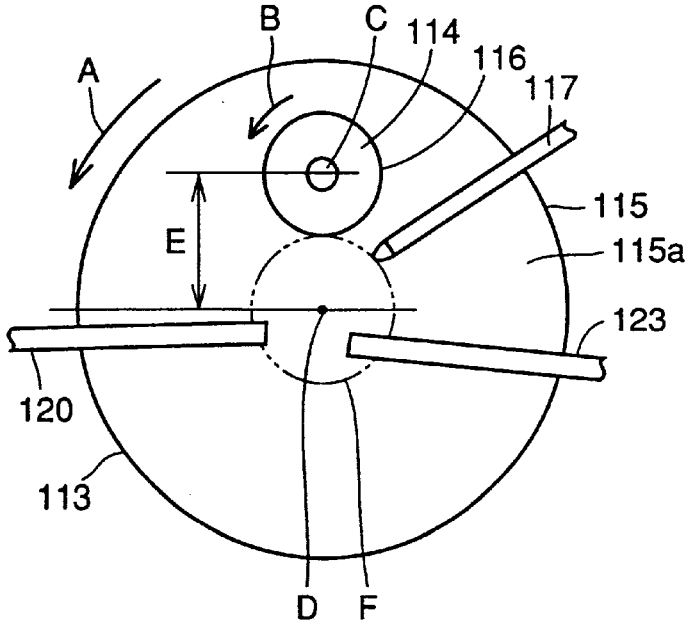
FIG. 22 PRIOR ART
FIG. 22 is a top view of the polishing apparatus shown in FIG. 21.
Figure 23:
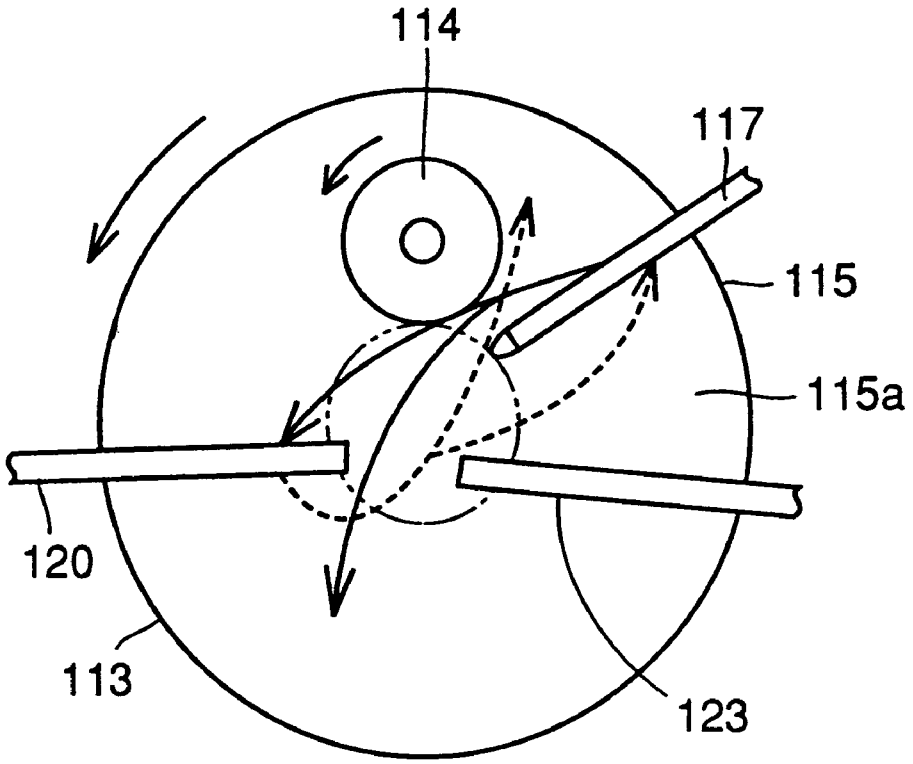
FIG. 23 PRIOR ART
FIG. 23 is a top view representing problems of the conventional polishing apparatus.

More specifically, in the first polishing step shown in FIG. 18, silicon oxide film 20 is polished with silica slurry, and the first polishing step is stopped when level difference L2 attains to about 3000 Å, thereafter, in the second polishing step shown in FIG. 19, silicon oxide film 20 positioned on silicon nitride film 14 as anti-polishing film is polished, using ceria slurry, and silicon nitride film 14 is exposed with silicon oxide film 20 left only in trench 18. In this manner, the basic structure of a semiconductor device having the STI structure is obtained. Thereafter, prescribed semiconductor elements and the like are formed on the element forming region of the trench-isolated semiconductor substrate, whereby a desired semiconductor device (not shown) is completed.

It is desirable that a step of dressing in which pad 2 is cleaned by dresser 4 is inserted between the first polishing step using silica slurry and the second polishing step using ceria slurry, in order to more positively remove the chipping or dirt after cleaning on pad 2. The step of dressing may be performed simultaneously, in parallel with the first or the second polishing step. This ensures that silicon oxide film 20 is always polished by pad 2 with higher cleanliness, and therefore the amount of polishing is further stabilized.

Further, after each of the first and second polishing steps, water polishing should preferably be performed on silicon oxide film 20, by supplying pure water as the polishing chemical liquid to pad 2.

In the method of manufacturing described above, as the polishing apparatus in accordance with the third embodiment is used, the polishing waste liquid containing the chemical liquid after polishing as well as chippings is surely removed from pad 2 by polishing chemical liquid draining mechanism 7, and the dressing waste liquid containing the chemical liquid for dressing after cleaning and dirt after cleaning is also surely removed from pad 2 by dressing chemical liquid draining mechanism 8.

Therefore, even when polishing chemical liquids of different types are used, mixture of one chemical liquid with the other can be prevented, and hence the above described two steps of polishing can be performed on one same platen.

When the above described two steps of polishing using polishing chemical liquids of different types are to be performed by a conventional polishing apparatus, there has been a possibility that one polishing chemical liquid is undesirably mixed with the other polishing chemical liquid. Therefore, it has been necessary to prepare two platens, perform the first step of polishing with silica slurry on one platen, and thereafter to perform the second step of polishing with ceria slurry on another platen. This means that time is necessary for changing the platens, and hence the process time becomes longer. When the two steps of polishing with different polishing chemical liquids are to be performed on one same platen, it is possible that a small amount of one of silica slurry and ceria slurry is mixed with the other, and in that case, polishing selectivity of silicon oxide film/silicon nitride film attains to about 1 to 2, resulting in further deterioration in control of the amount of polishing.

Therefore, when the polishing apparatus of the present invention is used in the steps of polishing during the manufacturing of the semiconductor devices, the problems experienced in the conventional polishing apparatus can be solved, and a plurality of steps of polishing using different polishing chemical liquids can be performed successively on one platen. Therefore, the process time can be reduced significantly and the manufacturing process can be simplified. Further, generation of microscratches on the surface to be polished of the wafer by chippings or dusts can effectively be prevented.

Though silica slurry and ceria slurry have been described as examples of polishing chemical liquids of different types in the embodiments above, the slurries are not limited thereto, and appropriate slurries may be selected dependent on the material or structure of the surface to be polished.

Further, though the step of polishing in the STI process has been described as an example of the method of manufacturing a semiconductor device, the polishing apparatus of the present invention is also applicable to the step of polishing performed to planarize an insulating film or the like formed to cover a step on a semiconductor substrate.

In the first to third embodiments, a partition plate 9 having a disk shaped and columnar side surface has been described as an example of a partition unit for preventing the polishing waste liquid after polishing from flowing to that region of pad 2 which goes away from the polishing chemical liquid draining mechanism when the pad is rotated, in addition to the polishing chemical liquid draining mechanism 7. The partition unit is not limited to the structure described above, and any means which can prevent flow of the waste liquid or the like may be used. For example, a recessed portion continuously surrounding the center of rotation of pad 2 may be used.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A polishing apparatus, comprising:

a polishing surface portion rotating about a center of rotation, for polishing a surface to be polished;

a polishing unit placed above and opposing to said polishing surface portion, for performing a series of polishing and cleaning operations;

a chemical liquid supplying unit placed on said polishing surface portion at a side which goes closer to said polishing unit when said polishing surface portion is rotated, for supplying a chemical liquid for polishing operation to said polishing surface portion; and a waste liquid draining unit placed on said polishing surface portion on a side which goes away from said polishing unit when said polishing surface portion is rotated, for draining waste liquid on said polishing surface portion; wherein a partition unit having an outer periphery formed to continuously surround the center of rotation of the polishing surface portion is provided to prevent said chemical liquid and said waste liquid on said polishing surface portion from flowing through a region near said center of rotation to a region on said polishing surface portion which is on a side going away from said waste liquid draining unit when said polishing surface portion is rotated, said waste liquid draining unit being arranged continuously from said partition unit to an outer periphery of said polishing surface portion.

2. The polishing apparatus according to claim 1, wherein said chemical liquid supplying unit has a foam body extending continuously from said partition unit to the outer periphery of said polishing surface portion, for uniformly supplying the chemical liquid to said polishing surface portion.

3. The polishing apparatus according to claim 2, wherein said waste liquid draining unit includes an evacuating unit for sucking said waste liquid, and a liquid removing unit provided in a preceding stage of said evacuating unit for removing liquid in said waste liquid.

4. The polishing apparatus according to claim 3, wherein said waste liquid draining unit includes a filter unit provided in a preceding stage of said liquid removing unit for removing solids contained in said waste liquid.

5. The polishing apparatus according to claim 1, wherein said waste liquid draining unit includes an evacuating unit for sucking said waste liquid, and a liquid removing unit provided in a preceding stage of said evacuating unit for removing liquid in said waste liquid.

6. The polishing apparatus according to claim 5, wherein said waste liquid draining unit includes a filter unit provided in a preceding stage of said liquid removing unit for removing solids contained in said waste liquid.

7. The polishing apparatus according to claim 1, wherein said polishing unit includes a substrate holding unit holding a semiconductor substrate and placing a surface to be polished of said semiconductor substrate opposed to said polishing surface portion, and a polishing surface cleaning unit for cleaning said polishing surface portion;

said chemical liquid supplying unit includes a polishing chemical liquid supplying unit for supplying a polishing chemical liquid to said polishing surface portion, and a cleaning liquid supplying unit for supplying a cleaning liquid to said polishing surface portion;

said waste liquid draining unit includes a polishing waste liquid draining unit for removing polishing waste liquid on said polishing surface portion, and a cleaning waste liquid draining unit for removing cleaning waste liquid on said polishing surface portion;

said units are arranged on said polishing surface portion along direction of rotation in the order of said polishing chemical liquid counting unit, said substrate holding unit, said polishing waste liquid draining unit, said cleaning liquid supplying unit, said polishing surface cleaning unit and said cleaning waste liquid draining unit; and said partition unit and said polishing waste liquid draining unit prevent said polishing chemical liquid and said polishing waste liquid from flowing to a region of said polishing surface portion which goes away from said polishing chemical liquid draining unit when said polishing surface portion is rotated, and said partition unit and said cleaning waste liquid draining unit prevent said cleaning liquid and said cleaning waste liquid from flowing to a region of said polishing surface portion which goes away from said cleaning waste liquid draining unit when said polishing surface portion is rotated.

* * * * *